US005508678A

United States Patent [19]

Tsunezawa et al.

[11] Patent Number: 5,508,678

[45] Date of Patent: Apr. 16, 1996

[54] HIGH-VOLTAGE VARIABLE RESISTOR UNIT

[75] Inventors: Ichiro Tsunezawa; Motoharu Higami, both of Toyama, Japan

[73] Assignee: Hokuriku Electric Industry Co., Ltd., Kami-Niikawgun, Japan

[21] Appl. No.: 377,513

[22] Filed: Jan. 24, 1995

[30] Foreign Application Priority Data

Apr. 5, 1994 [JP] Japan ..... 6-067099

[51] Int. Cl.[6] ..... H01C 10/30; H01C 13/00

[52] U.S. Cl. ..... 338/160; 338/70; 338/219; 338/162

[58] Field of Search ..... 338/160, 70, 219, 338/162

[56] References Cited

U.S. PATENT DOCUMENTS

| | | | |
|---|---|---|---|
| 4,402,037 | 8/1983 | Iwamura et al. | 338/219 X |
| 4,471,339 | 9/1984 | Fukada et al. | 338/162 |
| 4,527,147 | 7/1985 | Arakawa | 338/162 |
| 4,527,229 | 7/1985 | Imamura et al. | 363/126 |

FOREIGN PATENT DOCUMENTS 3-116005 12/1991 Japan .

4-32504 3/1992 Japan .

*Primary Examiner*—Marvin M. Lateef

*Attorney, Agent, or Firm*—Pearne, Gordon, McCoy & Granger

[57] ABSTRACT

A high-voltage variable resistor unit including a variable resistance circuit board and a fixed resistance circuit board, and capable of being down-sized and exhibiting satisfactory dielectric strength. A variable resistance circuit board which is provided on a front surface thereof with a variable resistance circuit pattern is received in a board receiving chamber of an insulating casing. A lid member made of an insulating resin material is arranged so as to close an opening of the board receiving chamber while keeping a front surface thereof facing a rear surface of the variable resistance circuit board. A fixed resistance circuit board is fixed on a rear surface of the lid member while keeping a rear surface thereof facing the rear surface of the lid member. A space for charging an insulating resin material therein is defined between a circuit board and the rear surface of the lid member. The lid member is provided on the rear surface thereof with both a creeping distance increase recess and a creeping distance increase projection in a manner to surround the circuit board.

16 Claims, 7 Drawing Sheets

HIGH-VOLTAGE VARIABLE RESISTOR UNIT

BACKGROUND OF THE INVENTION

This invention relates to a variable resistor unit for high voltage (hereinafter referred to as "high-voltage variable resistor unit"), and more particularly to a high-voltage variable resistor unit called a focus pack which is adapted to be used for adjusting a focus voltage of a CRT (cathode ray tube) or the like or a screen voltage thereof.

In general, such a high-voltage variable resistor unit is mounted on a transformer casing of a flyback transformer. A high-voltage variable resistor unit of which an applied voltage is decreased is conventionally constructed in such a manner that a variable resistance circuit pattern for a variable resistance and a fixed resistance circuit pattern for a fixed resistance called a bleeder resistance which is connected in series to the variable resistance circuit pattern are formed on a single insulating substrate. Unfortunately, the high-voltage variable resistor unit of this type, when the applied voltage is increased, tends to cause discharge between the resistance circuit patterns and/or between each of the resistance circuit patterns and an electrode. In view of the problem, an approach has been conventionally employed wherein the fixed resistance called a bleeder resistance which is positioned on a high-voltage side is arranged on another insulating substrate to provide a fixed resistance circuit board, which is then housed in a second board receiving chamber arranged in an insulating casing separately from a first board receiving chamber for receiving a variable resistance circuit board.

For example, a high-voltage variable resistor unit disclosed in Japanese Utility Model Application Laid-Open Publication No. 116005/1991 is so constructed that a fixed resistance circuit board is received in a second board receiving chamber provided in juxtaposition to a first board receiving chamber for receiving a variable resistance circuit board therein. Generation of any crack at an insulating casing causes discharge to readily occur between a circuit pattern on the fixed resistance circuit board and an external conductive section. In order to solve the problem, the high-voltage variable resistor unit disclosed in the publication is so constructed that the fixed resistance circuit board is supported by means of a holder so as to increase a creeping distance between a high potential section on the fixed resistance circuit board and a wall of the second board receiving chamber. Also, Japanese Utility Model Application Laid-Open Publication No. 32504/1992 discloses a high-voltage variable resistor unit including a holder of a box-like shape which is provided at one end thereof with an opening and adapted to receive a circuit board therein, resulting in being increased in dielectric strength characteristics with respect to an exterior.

In the conventional high-voltage variable resistor unit described above, the variable resistance circuit board received in the first board receiving chamber is charged on a rear surface thereof with epoxy resin, followed by curing of the resin to provide an insulating resin layer, and the second board receiving chamber is charged with resin for molding the fly-back transformer, followed by curing of the resin.

Arrangement of the second board receiving chamber for receiving the fixed resistance circuit board therein in juxtaposition to the first board receiving chamber for receiving the variable resistance circuit board therein leads to a disadvantage of significantly increasing an outer dimension of the insulating casing. In order to reduce the outer dimension, it is proposed to vertically partition the insulating casing into an upper compartment and a lower compartment, so that the variable resistance circuit board is received in the upper compartment and the fixed resistance circuit board is arranged in the lower compartment. Unfortunately, this renders insulation between the variable resistance circuit board and the fixed resistance circuit board substantially difficult, so that an increase in serviceable voltage causes discharge to readily occur therebetween.

Further, the above-described operation of charging epoxy resin of soft properties on the rear surface of the variable resistance circuit board to form the insulating resin layer leads to an increase in the number of steps required for assembling the high-voltage variable resistor unit, as well as an increase in the amount of insulating resin required for insulation.

SUMMARY OF THE INVENTION

The present invention has been made in view of the foregoing disadvantages of the prior art.

Accordingly, it is an object of the present invention to provide a high-voltage variable resistor unit which is capable of being down-sized and exhibiting satisfactory dielectric strength characteristics with respect to an exterior.

It is another object of the present invention to provide a high-voltage variable resistor unit which is capable of eliminating a necessity of forming an insulating resin layer on a rear surface of a variable resistance circuit board when resin for molding of a fly-back transformer is to be charged in an opening of an insulating casing.

It is another object of the present invention to provide a high-voltage variable resistor unit which is capable of effectively preventing resin for molding of a fly-back transformer from entering any board receiving chamber.

It is another object of the present invention to provide a high-voltage variable resistor unit which is capable of minimizing discharge between a variable resistance circuit board and a fixed resistance circuit board.

It is another object of the present invention to provide a high-voltage variable resistor unit which is capable of eliminating arrangement of any specific board receiving chamber for mounting of a fixed resistance circuit board and use of any separate holder.

It is another object of the present invention to provide a high-voltage variable resistor unit which is capable of facilitating mounting of a fixed resistance circuit board.

It is another object of the present invention to provide a high-voltage variable resistor unit which is capable of effectively preventing discharge between a fixed resistance circuit board and a conductive section arranged around the fixed resistance circuit board.

It is another object of the present invention to provide a high-voltage variable resistor unit which is capable of preventing transfer of a capacitor during charging of molding resin.

It is another object of the present invention to provide a high-voltage variable resistor unit which is capable of preventing an excessive increase in temperature of a board receiving chamber due to mounting of a fixed resistance circuit board on a rear surface of a lid or cover member.

In accordance with the present invention, a high-voltage variable resistor unit is provided. The high-voltage resistor unit includes a variable resistance circuit board having a variable resistance circuit pattern provided on a front surface thereof, an insulating casing made of insulating resin and formed therein with a board receiving chamber which is formed at one end thereof with an opening and in which the variable resistance circuit board is received, and a fixed resistance circuit board provided on a front surface thereof with a fixed resistance circuit pattern and received in the insulating casing. The fixed resistance circuit pattern is electrically connected to the variable resistance circuit pattern. The unit also includes at least one slide arranged in a space defined between the front surface of the variable resistance circuit board and an inner surface of a wall defining the board receiving chamber of the insulating casing and operated from an outside of the insulating casing and a lid member made of insulating resin and arranged for closing the opening of the board receiving chamber while keeping a front surface thereof facing a rear surface of the variable resistance circuit board. The fixed resistance circuit board is fixed on a rear surface of the lid member.

Also, in accordance with the present invention, a high-voltage variable resistor unit is provided. The unit includes a variable resistance circuit board having a variable resistance circuit pattern provided on a front surface thereof, an insulating casing made of insulating resin and formed therein with a board receiving chamber which is formed at one end thereof with an opening and in which the variable resistance circuit board is received, and a fixed resistance circuit board provided on a front surface thereof with a fixed resistance circuit pattern and received in place in the insulating casing. The fixed resistance circuit pattern is electrically connected to the variable resistance circuit pattern. The unit also includes at least one slide arranged in a space defined between the variable resistance circuit board and an inner surface of a wall defining the board receiving chamber of the insulating casing and operated from an outside of the insulating casing. The insulating casing is mounted on a transformer casing of a fly-back transformer and charged therein with molding resin, which is cured to form a molding resin layer in which the fixed resistance circuit board is embedded. The unit further includes a lid member arranged for closing the board receiving chamber to prevent the molding resin from entering the board receiving chamber while keeping a front surface thereof facing a rear surface of the variable resistance circuit board. The fixed resistance circuit board is fixed on a rear surface of the lid member while keeping a rear surface thereof facing the rear surface of the lid member.

In a preferred embodiment of the present invention, the fixed resistance circuit board is arranged on a side of the rear surface of the lid member so that an insulating resin charging space for charging insulating resin therein may be defined between the fixed resistance circuit board and the rear surface of the lid member.

In a preferred embodiment of the present invention, the rear surface of the lid member is integrally provided thereon with a plurality of holding elements and a spacer means. The holding elements are engaged with a pair of opposite end surfaces of the fixed resistance circuit board to interposedly hold the fixed resistance circuit board therebetween. The spacer means supports the fixed resistance circuit board in a manner to form the insulating resin charging space between the rear surface of the fixed resistance circuit board and the rear surface of the lid member.

In a preferred embodiment of the present invention, the rear surface of the lid member is provided thereon with creeping distance increase recesses and/or creeping distance increase projections. The creeping distance increase recesses and/or creeping distance increase projections are arranged at a portion of the rear surface of the lid member which is located between the fixed resistance circuit pattern of the fixed resistance circuit board and a conductive section arranged on the rear surface of the lid member and at which creeping discharge possibly occurs, to thereby increase a creeping distance between the fixed resistance circuit pattern and the conductive section.

In a preferred embodiment of the present invention, the wall for the board receiving chamber is provided on the inner surface thereof with board support ribs for supporting the variable resistance circuit board so as to define a space between the front surface of the variable resistance circuit board and an inner surface of the insulating casing. The front surface of the lid member is provided with a board contact rib contacted with the rear surface of the variable resistance circuit board.

In a preferred embodiment of the present invention, the lid member includes a lid body having the board contact rib provided on a front surface thereof and the fixed resistance circuit board mounted on a rear surface thereof and a fit peripheral wall arranged around the lid member. The wall for the board receiving chamber of the insulating casing is formed on an outside thereof with an annular fit groove in which the fit peripheral wall of the lid member is fitted.

In a preferred embodiment of the present invention, the lid body of the lid member is integrally provided on the rear surface thereof with at least one fit element or fit projection and the insulating casing is integrally provided at a portion thereof surrounding the opening of the board receiving chamber with a fit portion or fit recess with which the fit element or fit projection is fittedly engaged only when the fit peripheral wall has been fully fitted in the fit groove.

In a preferred embodiment of the present invention, the board contact rib formed on the front surface of the lid member includes an outer rib member arranged so as to extend along an outer edge of the variable resistance circuit board and an inner rib member positioned in a region surrounded by the outer rib member and partially contacted with the rear surface of the variable resistance circuit board.

In a preferred embodiment of the present invention, the lid member is formed on the rear surface thereof with a creeping distance increase projection in a discontinuous manner and so as to substantially surround a region thereof on which the fixed resistance circuit board is arranged.

In a preferred embodiment of the present invention, the lid member is integrally provided on the rear surface thereof with a plurality of holding elements engaged with a pair of opposite end surfaces of the fixed resistance circuit board to interposedly hold the fixed resistance circuit board therebetween. The holding elements are arranged so as to constitute a part of the creeping distance increase projection.

Further, in accordance with the present invention, a high-voltage variable resistor unit is provided. The unit includes a variable resistance circuit board having a variable resistance circuit pattern provided on a front surface thereof and an insulating casing made of insulating resin and formed at one end thereof with an opening. The insulating casing is formed therein with a board receiving chamber for receiving the variable resistance circuit board therein and a capacitor receiving chamber. The unit also includes a fixed resistance circuit board provided on a front surface thereof with a fixed resistance circuit pattern and received in place in the insulating casing. The fixed resistance circuit pattern is electrically connected to the variable resistance circuit pattern.

Further, the unit includes a capacitor arranged in the capacitor receiving chamber and connected to the variable resistance circuit pattern and fixed resistance circuit pattern and at least one slide arranged in a space defined between the variable resistance circuit board and an inner surface of a wall defining the board receiving chamber of the insulating casing and operated from an outside of the insulating casing. The insulating casing is mounted on a transformer casing of a fly-back transformer and charged therein with molding resin, which is cured to form a molding resin layer in which the fixed resistance circuit board and capacitor are embedded. The unit also includes a lid member arranged for closing the board receiving chamber to prevent the molding resin from entering the board receiving chamber while keeping a front surface thereof facing a rear surface of the variable resistance circuit board. The fixed resistance circuit board is fixed on a rear surface of the lid member while keeping a rear surface thereof facing a rear surface of the lid member.

In a preferred embodiment of the present invention, the fixed resistance circuit board is arranged on a side of the rear surface of the lid member while keeping the rear surface thereof facing the rear surface of the lid member so that an insulating resin charging space for charging insulating resin therein may be defined between the fixed resistance circuit board and the rear surface of the lid member.

In a preferred embodiment of the present invention, the rear surface of the lid member is integrally provided thereon with a plurality of holding elements and a spacer means. The holding elements is engaged with a pair of opposite end surfaces of the fixed resistance circuit board to interposedly hold the fixed resistance circuit board therebetween. The spacer means supports the fixed resistance circuit board in a manner to form the insulating resin charging space between the rear surface of the fixed resistance circuit board and the rear surface of the lid member.

In a preferred embodiment of the present invention, the rear surface of the lid member is provided thereon with at least one of creeping distance increase recesses and creeping distance increase projections. The creeping distance increase recesses and projections are arranged at a portion of the rear surface of the lid member which is located between the fixed resistance circuit pattern of the fixed resistance circuit board and a conductive section arranged on the rear surface of the lid member and at which creeping discharge possibly occurs, to thereby increase a creeping distance between the fixed resistance circuit pattern and the conductive section.

In a preferred embodiment of the present invention, the board receiving chamber and capacitor receiving chamber are arranged in juxtaposition to each other and the rear surface of the lid member is integrally provided at a portion thereof corresponding to a boundary between the board receiving chamber and the capacitor receiving chamber with at least one holding element. The holding element is arranged so as to extend toward the capacitor receiving chamber to prevent the capacitor received in the capacitor receiving chamber from moving toward the opening.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 1A:
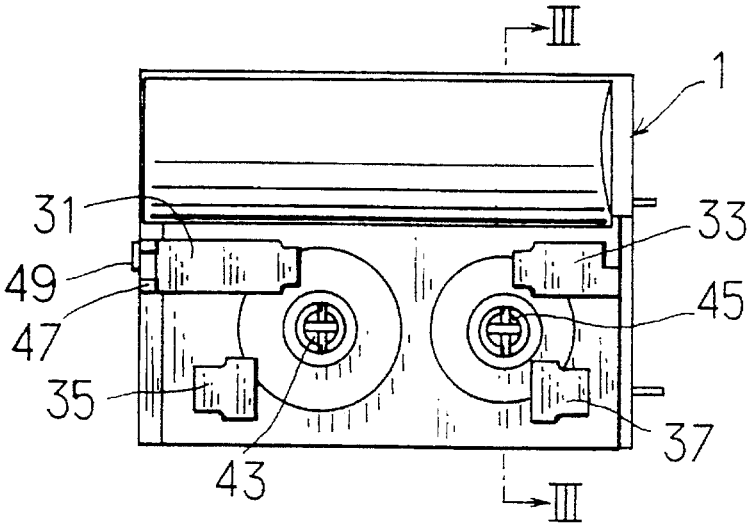
FIGS. 1(A) to 1(D) are a plan view, a bottom view, a left side elevation view and a right side elevation each showing an embodiment of a high-voltage variable resistor unit according to the present invention, respectively.
Figure 1B:
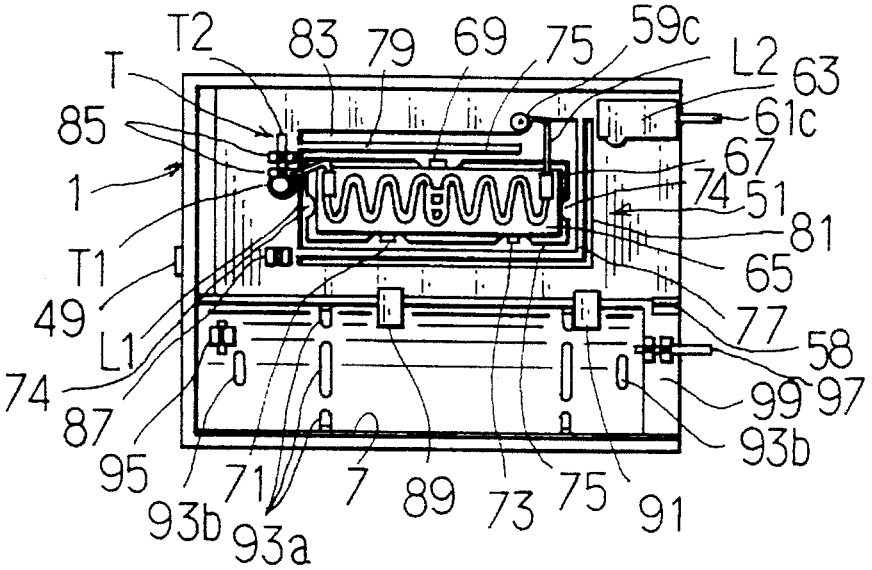
Figure 1C:
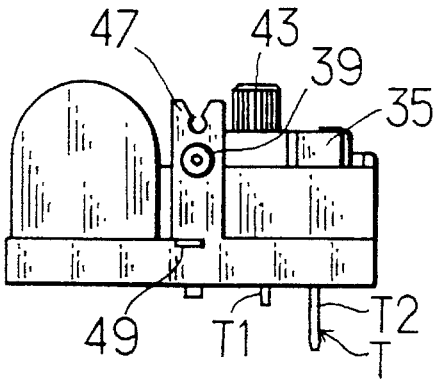

Now, a high-voltage variable resistor unit according to the present invention will be described hereinafter with reference to the accompanying drawings.

Referring first to FIGS. 1(A) to 3, an embodiment of a high-voltage variable resistor unit according to the present invention is illustrated. A high-voltage variable resistor unit of the illustrated embodiment is adapted to adjust a focus voltage of a CRT and a screen voltage thereof and generally called a focus pack. The high-voltage variable resistor unit of the illustrated embodiment includes an insulating casing 1 integrally formed of an insulating resin material such as Noryl (trademark), polybutylene terephthalate or the like. The unit also includes a circuit board 3 made of a ceramic material and formed thereon with a variable resistance circuit pattern including an input electrode El, a focus output electrode E2, a screen output electrode E3, a ground electrode E4, a focus voltage adjusting resistance element R1, a screen voltage adjusting resistance element R2 and additional resistance elements.

The insulating casing 1, as shown in FIG. 2, is formed on a bottom thereof with an opening and provided therein with a board receiving chamber 5 and a capacitor receiving chamber 7. The insulating casing 1 includes a double peripheral wall like a closed loop which is arranged so as to surround the board receiving chamber 5 and constituted by an inner wall section 9 and an outer wall section 11. Between the inner wall section 9 and the outer wall section 11 is defined a groove 13 of a rectangularly annular shape. The outer wall section 11 includes a wall portion 11*a* arranged along the capacitor receiving chamber 7, which functions as a partition for isolating the board receiving chamber 5 and capacitor receiving chamber 7 from each other. The inner wall section 9 is provided on an inner surface thereof with a plurality of ribs 15*a* to 15*d* which cooperate with each other to provide a board supporting rib structure for supporting the circuit board 3. The circuit board 3 is interposedly supported between the ribs 15*a* to 15*d* and a board contact rib 53 of a lid member 51 (FIG. 7(A)) which will be described hereinafter. When the lid member 51 is not provided with the board contact rib 53, the circuit board 3 may be mounted on the ribs 15*a* to 15*d* by means of a suitable adhesive such as a silicone resin adhesive, an epoxy resin adhesive or the like. The opening of the insulating casing 1 is surrounded at a portion thereof other than one side thereof by a opening-side peripheral wall section 17. The peripheral wall section 17 is adapted to be fitted in a fit groove provided at a casing of a fly-back transformer (not shown).

The inner wall section of the insulating casing 1 which is arranged so as to surround the board receiving chamber 5 is provided on an inner surface thereof with four terminal fitment fit portions 19, 21, 23 and 25. The terminal fitment fit sections 19 and 21 are adapted to be fitted on a terminal fitment 29 (FIGS. 4(A) and 5) provided in correspondence to the focus output electrode E2 and a terminal fitment provided in correspondence to the screen output electrode E3, respectively. The terminal fitment fit portions 23 and 25 are adapted to be fitted on terminal fitments 30 (FIGS. 4(C) and 6) provided in correspondence to the input electrode E1 and ground electrode E4, respectively.

The insulating casing 1, as shown in FIGS 1(A), is provided on an upper wall section thereof with four expansions 31, 33, 35 and 37 in correspondence to the terminal fitment fit portions 19, 21, 23 and 25, respectively. The expansions 31 and 33 each provide a connection conductor insertion section into which a connection conductor such as a pin terminal, a lead wire or the like is inserted. For this purpose, the expansions 31 and 33 are formed with through-holes 39 and 41, respectively. The insulating casing 1 includes an inner surface which cooperates with the circuit board 3 (FIGS. 2(B) and 3) to define a space therebetween in which two slides are rotatably arranged. Reference numerals 43 and 45 each designate an operating shaft arranged in a manner to upwardly rotatably extend through the upper wall section of the insulating casing 1, resulting in externally operating the slides. The expansion 31 is provided at an upper portion thereof with a lead wire holding hook 47, which serves to hold a screen voltage output lead wire (not shown) inserted into the through-hole 41 of the expansion 33. The screen voltage output lead wire is bent at a portion thereof positioned at an end of the expansion 33 and then heldly engaged with the hook 47, resulting in extending in the same direction as a focus voltage output lead wire and the screen voltage output lead wire. The insulating casing 1 is provided on an outer surface thereof with a projection 49, which is fitted in a fit recess provided at the transformer casing of the fly-back transformer, to thereby prevent upward movement of the insulating casing 1, when the high-voltage variable resistor unit of the illustrated embodiment is mounted on the fly-back transformer.

Figure 4A:
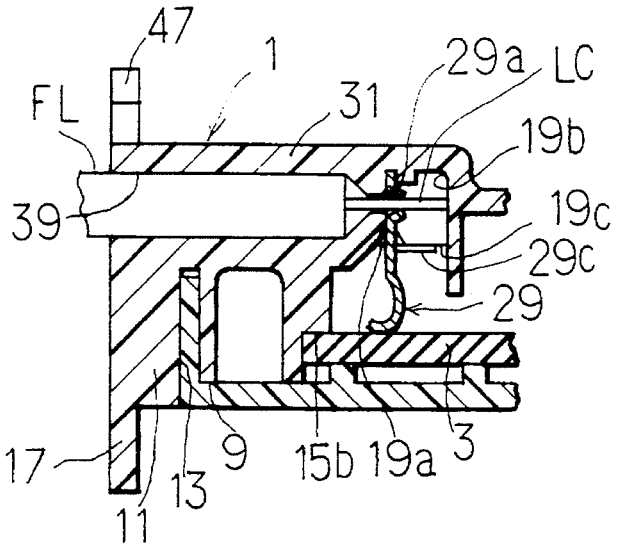
FIG. 4(A) is an enlarged sectional view showing the manner of mounting of a terminal fitment.
Figure 4B:
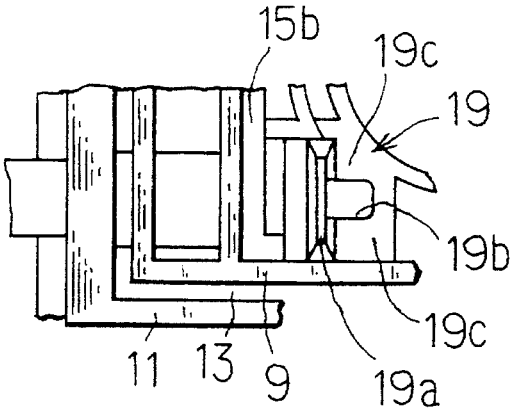
FIG. 4(B) is an enlarged plan view showing fitting of a terminal fitment.

The terminal fitment fit portions 19 and 21 are constructed in substantially the same manner and will be briefly described with reference to FIGS. 4(A) and 4(B) showing the terminal fitment fit portion 19 by way of example. The terminal fitment fit portion 19 includes a terminal fitment fit groove 19*a* formed so as to communicate with the through-hole 39 via which the focus voltage output lead wire is inserted and a core insertion hole 19*b* which is provided so as to communicate with the terminal fitment fit groove 19*a* and into which a distal end of a core of the lead wire is inserted. The terminal fitment fit portion 21 likewise includes a terminal fitment fit groove 21*a* and a core insertion hole 21*b*. The core insertion hole 19*a* is adapted to be abutted on both side surfaces 19*c* and 21*c* thereof positioned on a side of the opening or circuit board 3 against a flat-plate section 29*c* of the terminal fitment 29. Such abutment permits the terminal fitment 29 to be excessively forced against the fit grooves 19*a* and 21*a*, to thereby prevent deformation of a plate-like section 29*a* of the terminal fitment 29.

Figure 5A:
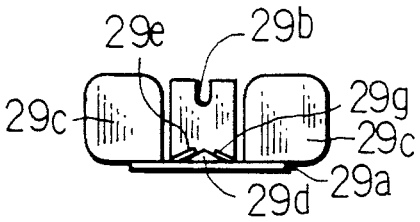
FIGS. 5(A), 5(B) and 5(C) are a plan view, a front elevation view and a right side elevation view each showing a terminal fitment, respectively.
Figure 5B:
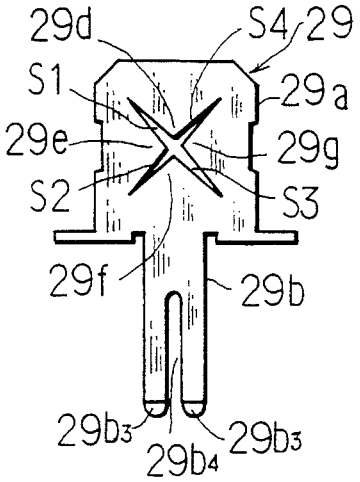
Figure 5C:
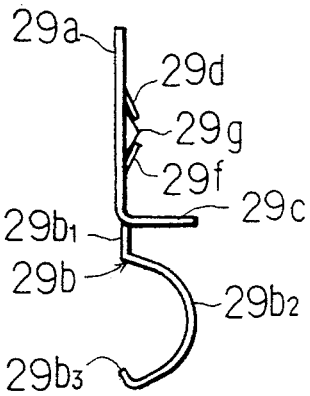

The terminal fitment 29 received in the terminal fitment fit portions 19 and 21 is formed by bending a conductive metal plate made of stainless steel, bronze or the like and cut into a predetermined shape. The terminal fitment 29 thus formed is adapted to be connected to a connection conductor without soldering. The conductive metal plate is preferably subject to bending so as to exhibit elasticity to a certain degree. For this purpose, a SUS 301 stainless steel plate of 0.1 to 0.4 mm in thickness, a bronze plate of 0.2 to 0.5 mm in thickness or the like may be used by way of example. FIG. 5(A) is a plan view of the terminal fitment 29, FIG. 5(B) is a front elevation view of the fitment 29 and FIG. 5(C) is a right side elevation view of the terminal fitment 29. The terminal fitment 29 includes the plate-like section 29*a* formed with a connection conductor holding portion for holding the connection conductor, a contact terminal section 29*b* formed by bending a strip-like portion integrally extending from the plate-like section 29*a* and the flat-plate section 29*c* having a surface extending in a direction intersecting a surface of the plate-like section 29*a*. The plate-like section 29*a* is formed into a substantially rectangular configuration and provided with four slits S1 to S4 in a manner to radially extend from a center thereof toward corners thereof, respectively. Between the slits adjacent to each other are defined four triangular edge portions 29*d* to 29*g* adapted to bite into an outer peripheral surface of the connection conductor inserted through the plate-like section 29*a*. The edge portions 29*d* to 29*g* are formed so as to be oblique in a direction of insertion of the connection conductor through the plate-like section 29*a*. The edge portions 29*d* to 29*g* each are provided with a pointed distal end, resulting in readily biting into the connection conductor to prevent dislocation of the connection conductor from the terminal fitment 29 when force in a direction of pulling the connection conductor out of the terminal fitment is applied to the connection conductor, The contact terminal section 29*b* is formed by bending the strip-like portion in order to provide the strip-like portion with elasticity and includes a base portion positioned on a side of the plate-like section 29*a* and including a straight portion 29*b*1 The straight portion 29*b*1 is provided for adjusting the height, therefore, it may be eliminated as required. Also, the contact terminal section 29*b* includes a curved portion 29*b*2 contiguous to the straight portion 29*b*1 and a contact portion 29*b*3 formed at a distal end of the curved portion 29*b*2 by curling. The curved portion 29*b*2 is formed with a single slit 29*b*4 so as to inwardly extend in a longitudinal direction thereof from the distal end thereof. The slit 29*b*4 is provided for finely adjusting elasticity of the curved portion 29*b*2 and providing the contact with a multi-contact function. Also, the elasticity may be adjusted depending on a width of the slit 29*b*4 and a length thereof.

The flat-plate section 29c is provided at an end of the plate-like section 29a positioned on a side of the contact terminals section 29b and the surface of the flat-like section 29c, as described above, is defined so as to extend in a direction perpendicular to the surface of the plate-like section 29a.

Figure 6A:
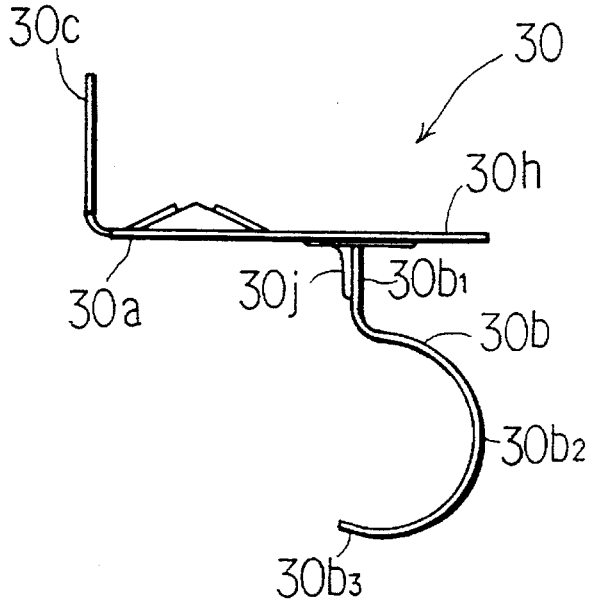
FIGS. 6(A), 6(B) and 6(C) are a front elevation view, a left side elevation view and a bottom view each showing a terminal fitment, respectively.
Figure 6B:
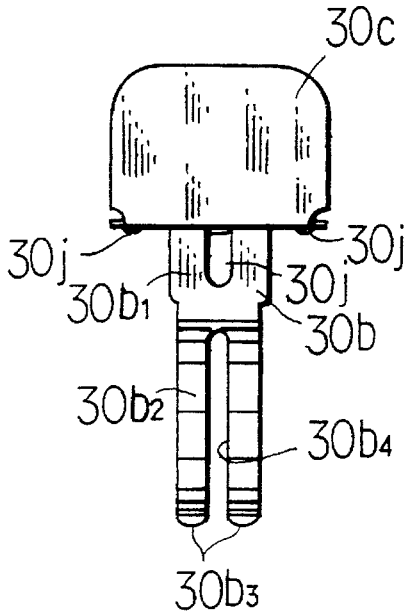
Figure 6C:
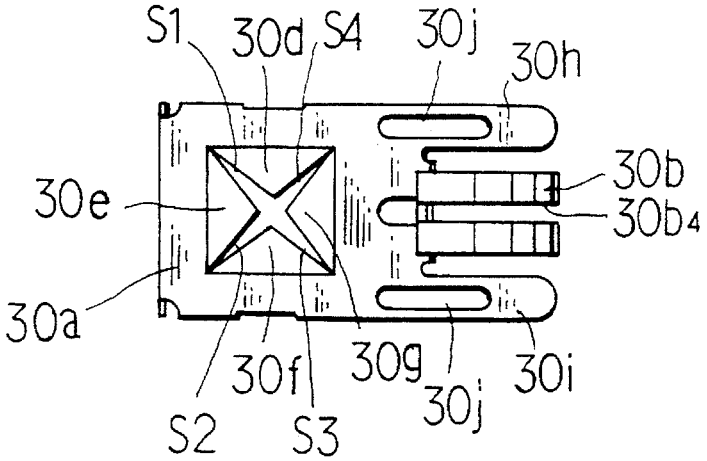

The terminal fitment 30 fitted in the terminal fitment fit sections 23 and 25 is constructed in such a manner as shown in FIGS. 6(A) to 6(C). FIG. 6(A) is a left side elevation view of the terminal fitment 30, FIG. 6(B) is a left side elevation view of the terminal fitment 30 and FIG. 6(C) is a bottom view of the terminal fitment 30. The terminal fitment 30 may be made of the same material as the terminal fitment 29. The terminal fitment 30 includes a plate-like section 30a formed with a connection conductor holding portion for holing a connection conductor, a contact terminal section 30b arranged so as to extend in a direction perpendicular to a surface of the plate-like section 30a or in a downward direction from one end of the plate-like section 30a, and a flat-plate section 30c arranged so as to extend in a direction perpendicular to the surface of the plate-like section 30a or in an upward direction from the other end of the plate-like section 30a. The plate-like section 30a is formed with four slits S1 to S4 in a manner to radially extend from a center thereof toward corners thereof. Between the slits adjacent to one another are defined four triangular edge portions 30d to 30g adapted to bite into an outer peripheral surface of the connection conductor inserted through the plate-like section 30a. The edge portions 30d to 30g are formed so as to be oblique in a direction of insertion of the connection conductor through the plate-like section 30a. The edge portions 30d to 30g each are provided with a pointed distal end, resulting in readily biting into the connection conductor to prevent dislocation of the connection conductor from terminal fitment 30 when force in a direction of pulling the connection conductor out of the terminal fitment is applied to the connection conductor, The contact terminal section 30b is formed by bending, resulting in being provided with elasticity. The contact terminal section 30b includes a base portion positioned on a side of the plate-like section 30a and including a straight portion 30b1. The straight portion 30b1 is provided for adjusting the height, therefore, it may be eliminated as desired. Also, the contact terminal section 30b includes a curved portion 30b2 contiguous to the straight portion 30b1 and a contact portion 30b3 formed at a distal end of the curved portion 30b2 by curling. The curved portion 30b2 is formed with a single slit 30b4 so as to inwardly extend in a longitudinal direction thereof from the distal end thereof. The slit 30b4 is provided for finely adjusting elasticity of the curved portion 30b2 and providing the contact with a multi-contact function. Also, the elasticity may be adjusted depending on a width of the slit 30b4 and a length thereof.

The plate-like section 30a is provided at an end thereof with a pair of reinforcing elements 30h and 30i so as to outwardly extend from the end thereof. The reinforcing elements 30h and 30i function to prevent the plate-like section 30a from being substantially deflected when the connection conductor is inserted into the contact terminals section 30b. The reinforcing elements 30h and 30i and the straight portion 30b1 of the contact terminal section 30b each have an elongated expansion 30j formed by pressing, to thereby increase mechanical strength thereof.

Figure 2A:
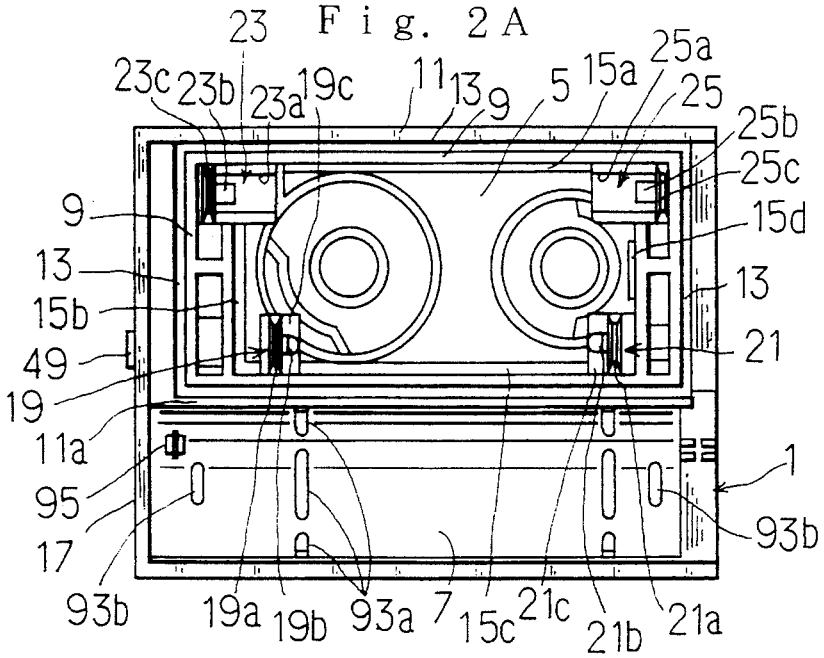
FIG. 2(A) is a bottom view showing an insulating casing.
Figure 2B:
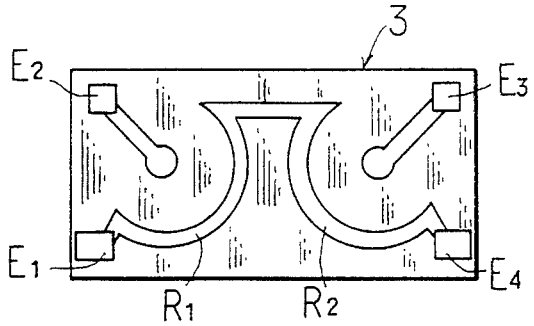
FIG. 2(B) is a plan view showing a circuit board.
Figure 4C:
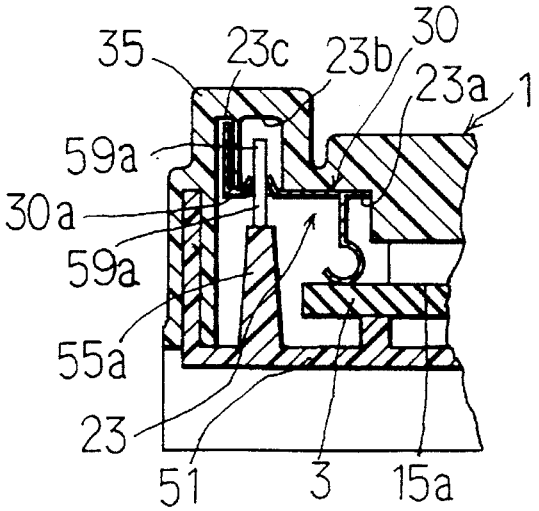
FIG. 4(C) is an enlarged sectional view showing arrangement of a recess for terminal connection.

The terminal fitment fit portions 23 and 25 are constructed in substantially the same manner and will be described with reference to FIGS. 4(C) and 2(A) showing the terminal fitment fit portion 23 by way of example. In the terminal fitment fit portion 23 is fitted the terminal fitment 30 for electrically connecting the input electrode E1 and a first connection conductor 59 described hereinafter to each other. The terminal fitment fit portion 23 includes a fit recess 23a in which the plate-like section 30a of the terminal fitment 30 is loosely fitted, a conductor insertion recess 23b into which one end 59a of the connection conductor 59 inserted into the connection conductor holding portion of the plate-like section 30a of the terminal fitment 30 is inserted, and a fit groove 23c in which the flat-plate section 30c of the terminal fitment 30 is fitted. Reference characters 25a, 25b and 25c designate a fit recess of the terminal fitment fit portion 25, a conductor insertion recess thereof and a fit groove thereof, respectively.

Figure 1D:
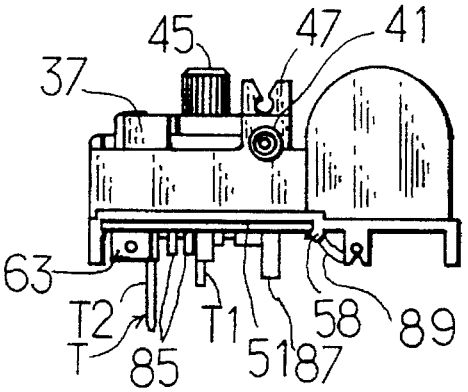
Figure 7A:
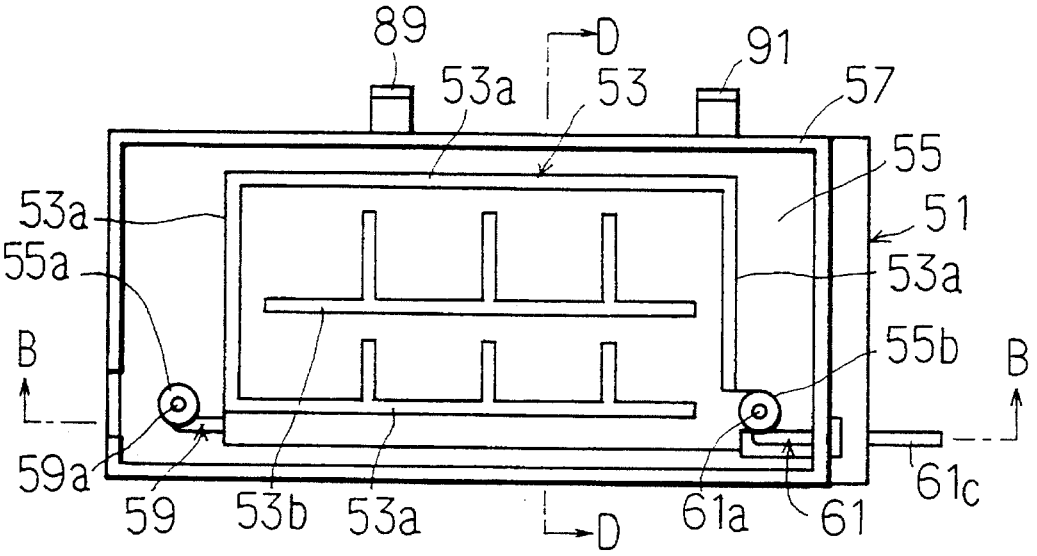
FIG. 7(A) is a plan view showing a lid member.
Figure 7B:
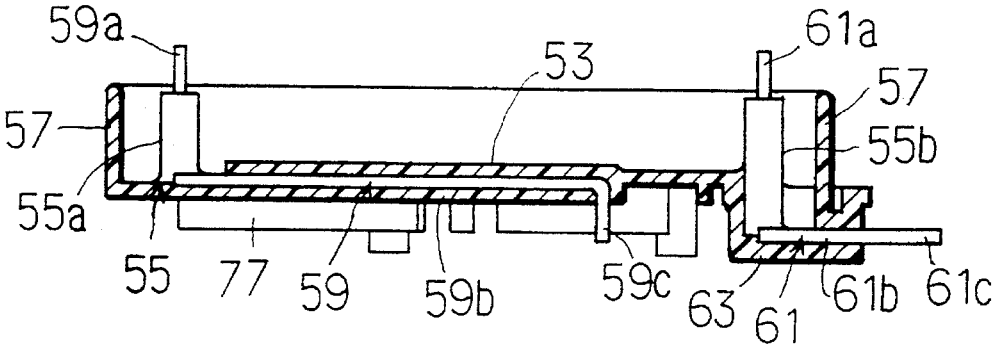
FIG. 7(B) is a sectional view of B—B line of FIG. 7(A)
Figure 7C:
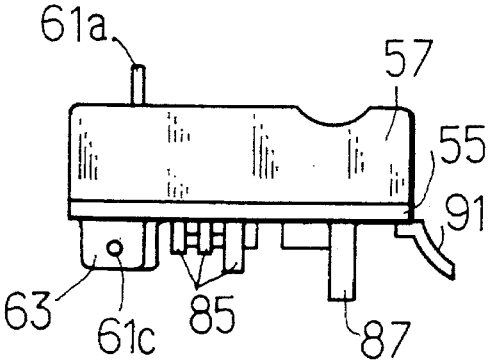
FIG. 7(C) is a side elevation view of the lid member shown in FIG. 7(A)
Figure 7D:
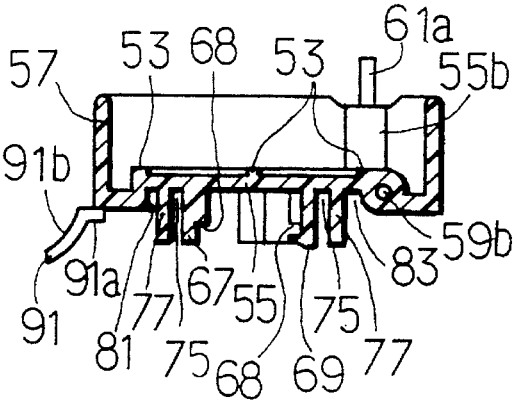
FIG. 7(D) is a sectional view of D—D line of FIG. 7(A)

The board receiving chamber 5 is closed with the lid member 51 which is made of such a synthetic resin material as used for formation of the insulating casing. FIG. 7(A) is a plan view of the lid member 51, FIG. 7(B) is a sectional view taken along line B—B of FIG. 7(A), FIG. 7(C) is a side elevation of the lid member 51, and FIG. 7(D) is a sectional view taken along line D—D of FIG. 7(A). The lid member 51 includes a lid body 55 of which a front surface is provided thereon with a board contact rib 53 and a rear surface has a fixed resistance circuit board fixed thereon, as well as a fit peripheral wall 57 provided around the lid body 51. The fit peripheral wall 57 of the lid member 51 is fitted in the fit groove 13 (FIG. 2) of the insulating casing 1, so that the lid member 51 closes the opening of the board receiving chamber 5 while being kept facing the rear surface of the variable resistance circuit board 3. Such a fit structure which permits fitting between the fit peripheral wall 57 and the fit groove 13 prevents insulating resin for molding from entering the board receiving chamber 5. Also, the fit structure permits the wall sections 9 and 11 arranged on both sides of the fit groove 13 and the fit peripheral wall 57 to form a triple wall structure around the board receiving chamber 5, to thereby increase both mechanical strength and dielectric strength of the board receiving chamber 5. The illustrated embodiment, as shown in FIGS. 1(A) and 1(D), is so constructed that the insulating casing 1 is provided with engagement elements 58, which are adapted to be engaged with corners of the lid member 55. Engagement between the engagement elements 58 and the corners of the lid member 51 ensures that the lid member 51 is positioned in place. The fit structure is sufficient to fix the lid member 51 on the insulating casing 1. Further, a suitable adhesive agent may be used for more firmly fixing the former on the latter.

The board contact rib 53 formed on the front surface of the lid body 55 of the lid member 51 includes an outer rib member 53a arranged so as to extend along an outer edge of the variable resistance circuit board 3 and an inner rib member 53b arranged so as to be surrounded by the outer rib member 53 and partly contacted with the rear surface of the variable resistance circuit board 3. Such arrangement of the board contact rib 53 permits the variable resistance circuit board 3 to be interposedly between the board support ribs 15a to 15d while preventing excessive force from being applied to the variable resistance circuit board 3. The board contact rib 53 may be formed into any desired configuration. Arrangement of the rib 53 may be eliminated as desired.

Reference numeral 61 designates a second connection conductor insert-molded together with the first connection conductor 59 with respect to the lid body 55 of the lid member 51. The first connection conductor 59 has one end 59a formed so as to extend from a projection 55a formed on the front surface of the lid body 55, an intermediate portion 59b formed so as to extend on the surface of the lid body 55 and the other end formed so as to project from the rear surface of the lid body 55. The second connection conductor 61 has one end 61*a* formed so as to extend from a projection 55*b* provided on the front surface of the lid body 55, an intermediate portion 61*b* formed so as to extend along an expansion 63 provided on the lid body 55 and through the fit peripheral wall 57, and the other end 61*c* formed so as to outwardly project from the fit peripheral wall 57. The other end 61*c* of the second connection conductor 61 acts as a ground terminal.

In the illustrated embodiment, the one end 59*a* of the first connection conductor 59 and the one end 61*a* of the second connection conductor 61 are inserted into the connection conductor holding section of the terminal fitment 30 fitted in the terminal fitment fit recesses 23 and 25 and then electrically connected through the terminal fitment to the electrodes E1 and E4 arranged on the variable resistance circuit board 3, respectively. Thus, it will be noted that the illustrated embodiment permits connection between the electrodes E1 to E4 and the connection conductor to be accomplished without soldering.

Figure 8:
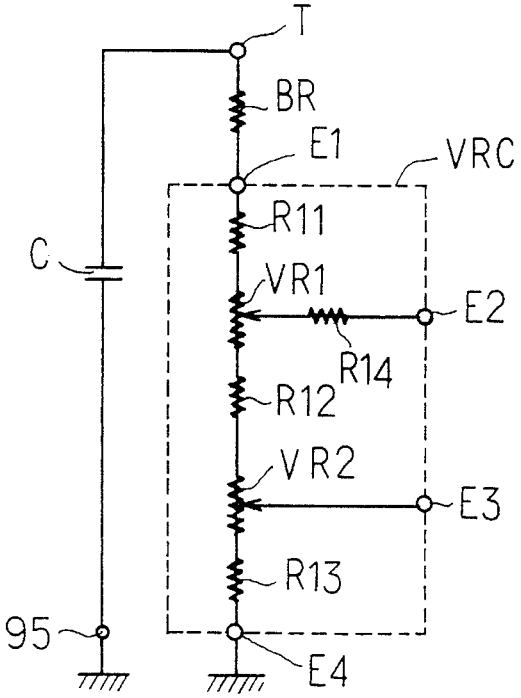
FIG. 8 is a circuit diagram of the high-voltage variable resistor unit shown in FIG. 1.

Reference numeral 65 is a fixed resistance circuit board which is arranged on the rear surface of the lid body 55 of the lid member 51 while keeping a rear surface thereof facing the rear surface of the lid member 51. The fixed resistance circuit board 65 may comprise an insulating substrate made of a ceramic material and a printed resistance element formed on the insulating substrate as in the variable resistance circuit board 3. A fixed resistance circuit pattern formed on a front surface of the fixed resistance circuit board 65 corresponds to a top bleeder resistance BR in a circuit shown in FIG. 8. In FIG. 8, parts corresponding to the electrodes and terminals shown in FIGS. 1, 2 and 7 are designated by like reference numerals. In FIG. 7, reference character VRC is a variable resistance circuit pattern formed on the variable resistance circuit board, wherein R11 to R14 each are a fixed resistance element, VR1 is a focus voltage adjusting resistance element and VRC is a screen voltage adjusting resistance element.

The lid body 55 of the lid member 51 is formed on the rear surface thereof with a creeping distance increase projection 67 in a manner to extend so as to substantially surround a region thereof on which the fixed resistance circuit board 65 is arranged. The creeping distance increase projection 67 includes three holding elements 69 to 73 arranged in a longitudinal direction of the fixed resistance circuit board 65, to thereby be engaged with a pair of opposite end surfaces of the fixed resistance circuit board 65, resulting in interposedly holding the fixed resistance circuit board 65 therebetween. Also, the creeping distance increase projection 67 is formed at each of portions thereof arranged opposite to each other in a width direction of the board 65 with a cutout 74, thus, it is provided in a manner to be discontinuous around the board 65. Formation of the projection 67 into a continuous configuration possibly causes discharge from an electrode of a high potential through a surface of the projection 67 to an electrode of a low potential. Arrangement of the discontinuous projection 67 is for the purpose of eliminating such a disadvantage.

Figure 3:
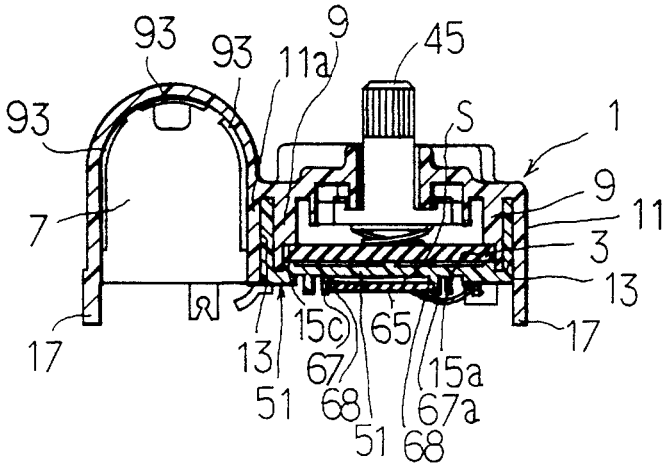
FIG. 3 is a sectional view taken along line III—III of FIG. 1(A)

The creeping distance increase projection 67, as shown in FIGS. 3 and 7(D), is formed on an inner surface thereof with a step 68 on which the circuit board 65 is arranged. Arrangement of the board 3 on the step 68 leads to formation of a space S between the rear surface of the circuit board 65 and the lid body 55 of the lid member 51. In the illustrated embodiment, the step 78 acts as a spacer means for supporting the circuit board 68. Alternatively, such a spacer means may be provided independent from the projection 67. In the illustrated embodiment, the space S is charged with resin for molding the fly-back transformer, to thereby provide an insulating resin layer. The insulating resin layer acts to prevent heat from being transmitted from the circuit board 65 directly to the lid member 55.

The creeping distance increase projection 67 thus arranged so as to substantially surround the circuit board 65 not only increases a creeping distance but acts as a positioning means for the fixed resistance circuit board 65. This prevents movement of the fixed resistance circuit board 65 during mounting of the fixed resistance circuit board 65 on the lid member 51. The holding elements 69 to 73, as shown in FIG. 7(D), each are formed into a hook-like shape so as to include a jaw contacted with both an end surface of the fixed resistance circuit board 65 and a front surface thereof. Thus, the circuit board 65 is to be mounted on the lid member 65, the holding elements each are outwardly inclined and then returned to the original position, resulting in interposedly holding the circuit board 65 therebetween. The holding element 69 is arranged at a substantially central position between the holding elements 71 and 73, so that the circuit board 65 may be held by three-point support.

Such three-point support permits the circuit board 65 to be positively held irrespective of a length of the circuit board. Arrangement of the holding elements 69 to 73 eliminates use of any adhesive for mounting of the circuit board 65 on the step 68 of the projection 67. Alternatively, a suitable adhesive may be used. In the latter case, the holding elements 69 to 73 act as a temporary holding means during curing of the adhesive.

Outside the creeping distance increase projection 67 is arranged a creeping distance increase recess 75 in a manner to surround the projection 67. Then, outside the creeping distance increase recess 75 are arranged a creeping distance increase projection 77 of an L-shape and a creeping distance increase projection 79 of a linear shape. Further, outside the projections 77 and 79 are arranged a creeping distance increase recess 81 of an L-shape and a creeping distance increase recess 83 of a linear shape. The projections and recesses thus arranged function to increase a creeping distance between a portion of the fixed resistance circuit pattern and a portion of a conductive section arranged on the rear surface of the lid body 55 between which creeping discharge possibly occurs. The conductive section which possibly causes the discharge includes the end 59*c* of the first connection conductor 59, the end 61*c* of the second connection conductor 61, a terminal fitment T held by a terminal fitment holding portion 85 projectedly provided on the rear surface of the lid body 55, and a body of a capacitor (not shown) and a lead wired thereof. The projections and recesses may be arranged in an order contrary to the above-described order.

The terminal fitment T is formed by bending a conductor such as a piano wire into a U-like shape and includes one terminal section T1 on which a lead wire L1 connected to an electrode on a high potential side of the fixed resistance circuit pattern is wound and fixed by soldering. Reference character L2 designates a lead wire which is connected to an electrode on a low potential side of the fixed resistance circuit pattern and fixedly wound on the end 59*c* of the first connection conductor 59 by soldering. The terminal fitment T also has the other terminal section T2 pointed at a tip end thereof and inserted into a plug-in metal terminal. The terminal fitment holding portion 85 includes two holding elements for holding a proximal portion of the terminal fitment T and one holding element for holding one of the terminal sections of the terminal fitment.

The lid body 55 is provided on the rear surface thereof with a lead wire holding section 87 in a manner to be in proximity to the terminal fitment holding portion. The lead wire holding section 87 is adapted to permit one lead wire of the capacitor received in the capacitor receiving chamber 7 to be heldly engaged therewith. The lead wire is connected to the terminal section T1 of the terminal fitment T by soldering.

The lid body 55 is also provided on the rear surface thereof with a pair of holding elements 89 and 91, which are arranged at a position corresponding to a boundary between the base receiving chamber 5 and the capacitor receiving chamber 7 in a manner to extend toward the capacitor receiving chamber 7, to thereby prevent movement of the capacitor toward the opening. The holding elements 89 and 91 each include a flat-plate portion 91*a* extending in parallel to the rear surface of the lid body 55 and a curved portion 91*b* extending from the flat-plate portion. The curved portion is formed into a shape in conformity to that of the capacitor. In the illustrated embodiment, two such holding elements 89 and 91 which are formed into a reduced width are used for facilitating insertion of the capacitor. However, only at least one such holding element may be required.

A Wall defining the capacitor receiving chamber 7 is integrally provided on an inner surface thereof with a rib 93*a* for holding the capacitor while keeping it separate from the inner surface of the capacitor receiving chamber 7 and a rib 93*b* for preventing movement of the capacitor in an axial direction thereof. Also, the wall for the capacitor receiving chamber 7 is integrally provided on the inner surface thereof with a lead wire holding element 95 for holding the lead wire of the capacitor. Further, the wall for the capacitor receiving chamber 7 is provided on one edge thereof defined in a longitudinal direction thereof with a flat-plate portion 96, which is integrally mounted thereon with a terminal holder 99 for holding a connection terminal (ground terminal) 97 for connection of the other lead wire of the capacitor. The flat-plate portion 96 is integrally provided with the holding element 58 which are engaged with each of the corners of the lid body 55 of the lid member 51.

The illustrated embodiment is so constructed that the spacer means 68 for supporting the fixed resistance circuit board. 65 so as to define the insulating resin charge space S between the rear surface of the fixed resistance circuit board 65 and the rear surface of the lid member 51 is integrally provided on the rear surface of the lid member 51. Thus, the insulating resin layer is formed between the rear surface of the fixed resistance circuit board 65 and the lid member 51 to minimize transmission of heat generated by the fixed resistance circuit board 65 to the board receiving chamber.

In the illustrated embodiment, the lid member 51 is integrally mounted on the rear surface thereof with a plurality of the holding elements 69 to 73 engaged with a pair of the opposite end surfaces of the fixed resistance circuit board 65 to interposedly hold the fixed resistance circuit board 65. Thus, fixing of the fixed resistance circuit board on the lid member may be accomplished without using any adhesive. In addition, such construction, when any suitable adhesive is used, eliminates a necessity of temporarily holding the fixed resistance circuit board by any separate means during curing of the adhesive. The number of holding elements to be arranged and the manner of arrangement thereof may be determined as desired. When the holding elements are engaged with a pair of the end surfaces of the fixed resistance circuit board defined in the longitudinal direction of the fixed resistance circuit board, it is preferable that two such holding elements are arranged on one of the end surfaces and one such holding element is arranged on the other end surface. Also, it is preferable that the holding element on the other end surface is located between the two holding elements on the one end surface. Such arrangement permits the number of holding elements required for holding the fixed resistance circuit board to be minimized irrespective of a length of the fixed resistance circuit board.

Also, use of a holder for covering a resistance surface of the fixed resistance circuit board 65 in arrangement of the fixed resistance circuit board on the rear surface of the lid member 51 significantly restrains creeping discharge between the fixed resistance circuit pattern and the conductive section arranged on the rear surface of the lid member 51. Thus, such a holder may be conveniently used in the present invention, although use of the holder causes an increase in the number of parts used, leading to an increase in cost. Alternatively, arrangement of the fixed resistance circuit board on the lid member 51 may be preferably carried out by providing, on the rear surface of the lid member, a creeping distance increase recess and/or a creeping distance increase projection which increase a creeping distance between a portion of the fixed resistance circuit pattern and a portion of the conductive section arranged on the rear surface of the lid member which possibly cause creeping discharge. A configuration of the creeping distance increase recess and/or projection and a pattern of arrangement of the recess and/or projection may be determined as desired so long as they permit the creeping distance between the fixed resistance circuit pattern and the conductive section to be significantly increased. The recess and/or projection are preferably formed so as to fully surround a periphery of the fixed resistance circuit board. Alternatively, they may be arranged so as to partially surround it. When the creeping distance increase projection is arranged in a manner to be in proximity to the fixed resistance circuit board and fully surround it, it may be preferably formed in a discontinuous manner. Formation of the projection in a continuous manner possibly causes discharge from a high potential electrode through a surface of the projection toward a low potential electrode.

In the illustrated embodiment, the board contact rib 53 is arranged on the lid member 51, so that the movable resistance circuit board 3 may be fixed in a place in the board receiving chamber 5. Also, the illustrated embodiment permits the variable resistance circuit board 3 to be interposedly supported between the board support rib provided on the insulating casing 1 and the board contact rib 53 provided on the lid member 51 without applying excessive force to the variable resistance circuit board 3. Further, in the illustrated embodiment, the creeping distance increase projection 67 exhibits a mark function indicating a region at which the fixed resistance circuit board 65 is fixed, resulting in mounting of the fixed resistance circuit-board being facilitated. The creeping distance increase projection 67 acts as a positioning means for the fixed resistance circuit board 65, to thereby prevent movement of the fixed resistance circuit board during mounting of the fixed resistance circuit board. In particular, the creeping distance increase projection 67 is formed in a discontinuous manner, so that discharge is effectively prevented from occurring directly from the electrode on the high potential side to that of the low potential side along the surface of the creeping distance increase projection 67.

Figure 9A:
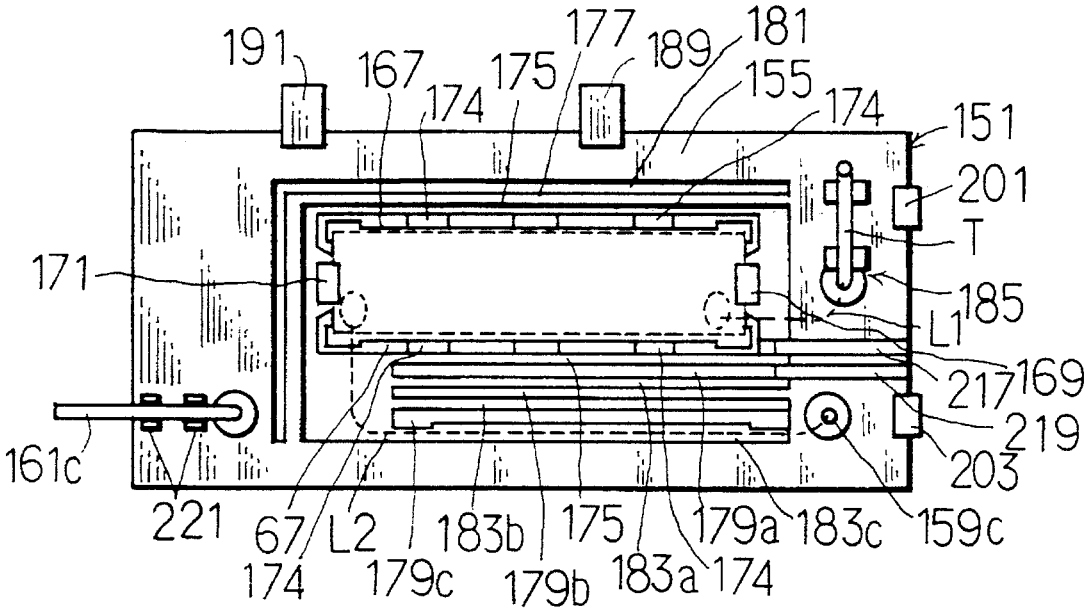
FIGS. 9(A) to 9(C)) are a bottom view, a sectional view and a side elevation view each showing a lid member incorporated in another embodiment of a high-voltage variable resistor unit according to the present invention.
Figure 9B:
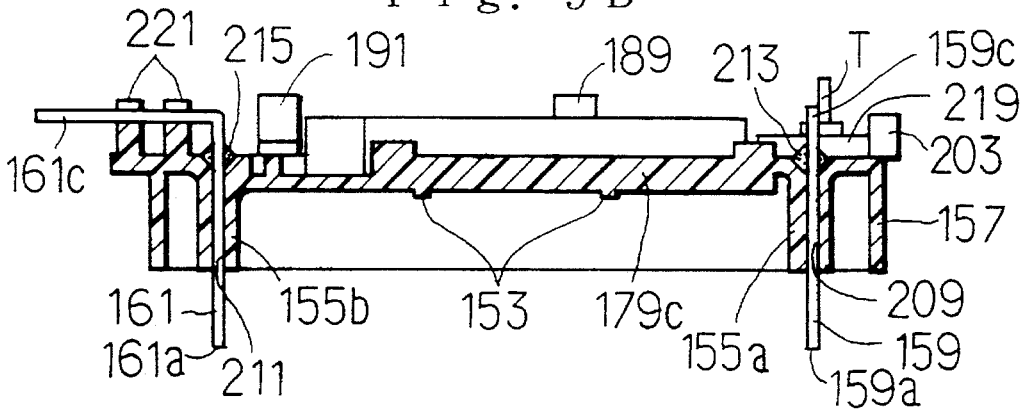
Figure 9C:
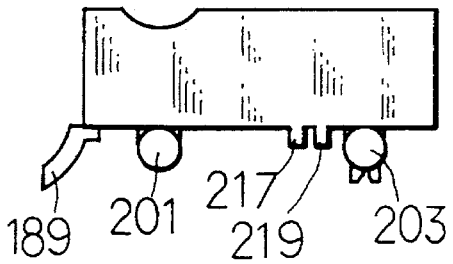
Figure 9D:
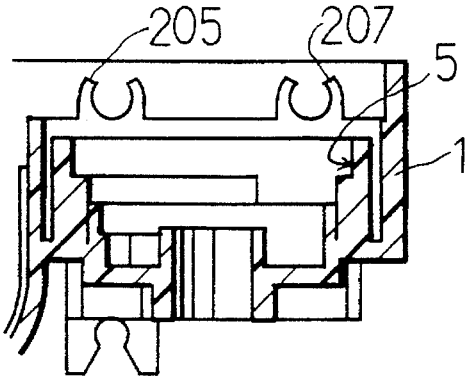
FIG. 9(D) is an enlarged view showing a modification of an insulating casing in which the lid member of FIG. (9) is fitted.

FIGS. 9(A) to 9(C) show a lid member 151 incorporated in another embodiment of a high-voltage variable resistor unit according to the present invention, wherein FIG. 9(A) is a bottom view of the lid member 151, FIG. 9(B) is a sectional view of the lid member and FIG. 9(C) is a side elevation view of the lid member. FIG. 9(D) is an enlarged view showing a modification of an insulating casing in which the lid member is fitted. Parts of the lid member 151 corresponding to those in the embodiment described above with reference to FIGS. 1 to 7 are designated by like reference characters represented by adding numeral "100" to reference characters used for indicating the parts shown in FIGS. 1 to 7. In the second embodiment, the lid member 151 is provided on a rear surface thereof with at least one fit element or fit projection. In the illustrated embodiment, two such fit projections 201 and 203 are arranged. The projections 201 and 203 each are provided at a distal end thereof with a portion circular in section. In correspondence to the fit projections 201 and 203, a wall defining a board receiving chamber 5 of an insulating casing 1 is provided on an end thereof with a fit portions or fit recesses 205 and 207. The fit recesses 205 and 207 each are formed with a fit hole of a C-shape as viewed sideways so that the fit projections may be tightly fitted in the fit recesses 205 and 207, respectively. Fitting between the fit projections 201 and 203 and the fit recesses 205 and 207 is ascertained for judging satisfactory mounting of the lid member 151, to thereby minimize a decrease in yield of manufacturing of the high-voltage variable resistor unit due to a failure in assembling of the unit. Also, fitting between the fit projections and the fit recesses permits the lid member to be kept firmly held in place in the insulating casing during charging of the molding resin without using any adhesive for fixing the lid member 151 on the insulating casing 1.

Further, the illustrated embodiment is so constructed that a first connection conductor 159 and a second connection conductor 161 are merely inserted via through-holes 209 and 211 formed via a lid body 155 of the lid member 151 and then fixed to the lid body 155 by means of adhesives 213 and 215, respectively. The connection conductor is made of a conductive material of a linear shape and the second connection conductor 161 is made of a conductive material bent into an L-shape. The first connection conductor 159 has an end 159*c* exposed in proximity to a terminal fitment T, to thereby reduce a creeping distance between the end 159*c* of the first connection conductor 159 and the terminal fitment T. Thus, in the illustrated embodiment, creeping distance increase projections 217 and 219 are arranged between the end 159*c* of the conductor 159 and the terminal fitment T. Exposure of the end 159*c* of the first connection conductor 159 in proximity to the terminal fitment T causes a lead wire L2 indicated at broken lines which carries out connection between the end 159*c* of the conductor 159 and an electrode arranged on a low potential side of a fixed resistance circuit board (not shown) and indicated at broken lines to be exposed over a long distance along the fixed resistance circuit board. In view of the fact, the illustrated embodiment is so constructed that creeping distance increase projections 179*a* to 179*c* and creeping distance increase projections 183*a* to 183*c* are repeatedly arranged between the lead wire L2 and the fixed resistance circuit board, to thereby increase a creeping distance therebetween.

The second connection conductor 161 acting as a ground terminal has an end 161*c* held by a pair of terminal holders 221.

As can be seen from the foregoing, the present invention is so constructed that the lid member made of an insulating resin material is arranged for covering the opening of the board receiving chamber, to thereby provide insulation on a side of the rear surface of the variable resistor circuit board without arrangement of any insulating resin layer. Also, mounting of the fixed resistance circuit board on the rear surface of the lid member eliminates a necessity of arranging a board receiving chamber exclusively used for receiving the fixed resistance circuit board therein, to thereby down-size the insulating casing. In addition, this permits dielectric strength of the insulating casing to be increased, resulting in effectively preventing discharge from the fixed resistance circuit board.

In the conventional high-voltage variable resistor, a rib is provided for merely holding a lead wire of a capacitor in a holder arranged in place or forcibly contacting an outer surface of the capacitor in an inner side of a capacitor receiving chamber, to thereby restrain movement of the capacitor during charging of a molding resin material. Unfortunately, the molding resin thus charged acts to upwardly move the capacitor from a bottom side of the capacitor receiving chamber, resulting in a body of the capacitor being apt to outwardly partly project from an opening of the capacitor receiving chamber. However, in the prior art, it is not possible to provide an insulating casing with any holding elements in view of drawing of a mold used for forming the insulating casing. On the contrary, use of the lid member in the present invention permits at least one holding element to be provided integrally with the lid member in a manner to extend to a position corresponding to a boundary between the board receiving chamber on the rear surface of the lid member and the capacitor receiving chamber toward the capacitor receiving chamber, to thereby prevent movement of the capacitor received in the capacitor receiving chamber toward the opening. Thus, such arrangement of the holding element on the lid member positively prevents movement of the capacitor. The holding element is of course required to be arranged so as not to disturb insertion of the capacitor into the capacitor receiving chamber.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A high-voltage variable resistor unit comprising:

a variable resistance circuit board having a variable resistance circuit pattern provided on a front surface thereof;

an insulating casing made of insulating resin and formed therein with a board receiving chamber which is formed at one end thereof with an opening and in which said variable resistance circuit board is received;

a fixed resistance circuit board provided on a front surface thereof with a fixed resistance circuit pattern and received in said insulating casing, said fixed resistance circuit pattern being electrically connected to said variable resistance circuit pattern;

at least one slide arranged in a space defined between said front surface of said variable resistance circuit board and an inner surface of a wall defining said board receiving chamber of said insulating casing and operated from an outside of said insulating casing; and a lid member made of insulating resin and arranged for closing said opening of said board receiving chamber while keeping a front surface thereof facing a rear surface of said variable resistance circuit board;

said fixed resistance circuit board being fixed on a rear surface of said lid member.

2. A high-voltage variable resistor unit as defined in claim 1, wherein said insulating casing is mounted on a transformer casing of a fly-back transformer and charged therein with molding resin, which is cured to form a molding resin layer in which said fixed resistance circuit board is embedded.

3. A high-voltage variable resistor unit as defined in claim 2, wherein said fixed resistance circuit board is arranged on a side of said rear surface of said lid member so that an insulating resin charging space for charging insulating resin therein may be defined between said fixed resistance circuit board and said rear surface of said lid member.

4. A high-voltage variable resistor unit as defined in claim 3, wherein said rear surface of said lid member is integrally provided thereon with a plurality of holding elements and a spacer means;

said holding elements being engaged with a pair of opposite end surfaces of said fixed resistance circuit board to interposedly hold said fixed resistance circuit board therebetween;

said spacer means supporting said fixed resistance circuit board in a manner to form said insulating resin charging space between said rear surface of said fixed resistance circuit board and said rear surface of said lid member.

5. A high-voltage variable resistor unit as defined in claim 4, wherein said rear surface of said lid member is provided thereon with creeping distance increase recesses and/or creeping distance increase projections;

said creeping distance increase recesses and/or creeping distance increase projections being arranged at a portion of said rear surface of said lid member which is located between said fixed resistance circuit pattern of said fixed resistance circuit board and a conductive section arranged on said rear surface of said lid member and at which creeping discharge possibly occurs, to thereby increase a creeping distance between said fixed resistance circuit pattern and said conductive section.

6. A high-voltage variable resistor unit as defined in claim 1, wherein said wall for said board receiving chamber is provided on said inner surface thereof with board support ribs for supporting said variable resistance circuit board so as to define a space between said front surface of said variable resistance circuit board and an inner surface of said insulating casing; and said front surface of said lid member is provided with a board contact rib contacted with said rear surface of said variable resistance circuit board.

7. A high-voltage variable resistor unit as defined in claim 6, wherein said lid member includes a lid body having said board contact rib provided on a front surface thereof and said fixed resistance circuit board mounted on a rear surface thereof and a fit peripheral wall arranged around said lid member;

said wall for said board receiving chamber of said insulating casing is formed on an outside thereof with an annular fit groove in which said fit peripheral wall of said lid member is fitted.

8. A high-voltage variable resistor unit as defined in claim 7, wherein said lid body of said lid member is integrally provided on said rear surface thereof with at least one fit element or fit projection; and said insulating casing is integrally provided at a portion thereof surrounding said opening of said board receiving chamber with a fit portion or fit recess with which said fit element or fit projection is fittedly engaged only when said fit peripheral wall has been fully fitted in said fit groove.

9. A high-voltage variable resistor unit as defined in claim 6, wherein said board contact rib formed on said front surface of said lid member includes an outer rib member arranged so as to extend along an outer edge of said variable resistance circuit board and an inner rib member positioned in a region surrounded by said outer rib member and partially contacted with said rear surface of said variable resistance circuit board.

10. A high-voltage variable resistor unit as defined in claim 1, wherein said lid member is formed on said rear surface thereof with a creeping distance increase projection in a discontinuous manner and so as to substantially surround a region thereof on which said fixed resistance circuit board is arranged.

11. A high-voltage variable resistor unit as defined in claim 10, wherein said lid member is integrally provided on said rear surface thereof with a plurality of holding elements engaged with a pair of opposite end surfaces of said fixed resistance circuit board to interposedly hold said fixed resistance circuit board therebetween;

said holding elements being arranged so as to constitute a part of said creeping distance increase projection.

12. A high-voltage variable resistor unit comprising:

a variable resistance circuit board having a variable resistance circuit pattern provided on a front surface thereof;

an insulating casing made of insulating resin and formed at one end thereof with an opening;

said insulating casing being formed therein with a board receiving chamber for receiving said variable resistance circuit board therein and a capacitor receiving chamber;

a fixed resistance circuit board provided on a front surface thereof with a fixed resistance circuit pattern and received in place in said insulating casing, said fixed resistance circuit pattern being electrically connected to said variable resistance circuit pattern;

a capacitor arranged in said capacitor receiving chamber and connected to said variable resistance circuit pattern and fixed resistance circuit pattern;

at least one slide arranged in a space defined between said variable resistance circuit board and an inner surface of a wall defining said board receiving chamber of said insulating casing and operated from an outside of said insulating casing;

said insulating casing being mounted on a transformer casing of a fly-back transformer and charged therein with molding resin, which is cured to form a molding resin layer in which said fixed resistance circuit board and capacitor are embedded; and a lid member arranged for closing said board receiving chamber to prevent said molding resin from entering said board receiving chamber while keeping a front surface thereof facing a rear surface of said variable resistance circuit board;

said fixed resistance circuit board being fixed on a rear surface of said lid member while keeping a rear surface thereof facing a rear surface of said lid member.

13. A high-voltage variable resistor unit as defined in claim 12, wherein said fixed resistance circuit board is arranged on a side of said rear surface of said lid member while keeping said rear surface thereof facing said rear surface of said lid member so that an insulating resin charging space for charging insulating resin therein may be defined between said fixed resistance circuit board and said rear surface of said lid member.

14. A high-voltage variable resistor unit as defined in claim 13, wherein said rear surface of said lid member is integrally provided thereon with a plurality of holding elements and a spacer means;

said holding elements being engaged with a pair of opposite end surfaces of said fixed resistance circuit board to interposedly hold said fixed resistance circuit board therebetween;

said spacer means supporting said fixed resistance circuit board in a manner to form said insulating resin charging space between said rear surface of said fixed resistance circuit board and said rear surface of said lid member.

15. A high-voltage variable resistor unit as defined in claim 14, wherein said rear surface of said lid member is provided thereon with at least one of creeping distance increase recesses and creeping distance increase projections;

said creeping distance increase recesses and projections being arranged at a portion of said rear surface of said lid member which is located between said fixed resistance circuit pattern of said fixed resistance circuit board and a conductive section arranged on said rear surface of said lid member and at which creeping discharge possibly occurs, to thereby increase a creeping distance between said fixed resistance circuit pattern and said conductive section.

16. A high-voltage variable resistor unit as defined in claim 12, wherein said board receiving chamber and capacitor receiving chamber are arranged in juxtaposition to each other; and said rear surface of said lid member is integrally provided at a portion thereof corresponding to a boundary between said board receiving chamber and said capacitor receiving chamber with at least one holding element;

said holding element being arranged so as to extend toward said capacitor receiving chamber to prevent said capacitor received in said capacitor receiving chamber from moving toward said opening.

* * * * *